1/26/88 XR 4,722,058

United States Patent [19]
Nakayama et al.

[11] Patent Number: 4,722,058
[45] Date of Patent: Jan. 26, 1988

[54] CONTROL SYSTEM FOR A VENDING MACHINE USING ARTICLE FRESHNESS DATA

[75] Inventors: Nobuo Nakayama; Yukio Makita; Haruo Kawasaki; Yoshihiro Sashikawa; Satoru Umino; Shinsuke Tajiri; Tetsuya Miyao; Shozo Iwamoto, all of Kanagawa, Japan

[73] Assignee: Fuji Electric Company Ltd., Kanagawa, Japan

[21] Appl. No.: 739,436

[22] Filed: May 30, 1985

[51] Int. Cl.[4] ..... G07F 11/00
[52] U.S. Cl. ..... 364/479; 221/9; 221/10; 221/12; 340/825.35; 235/381
[58] Field of Search ..... 221/2, 6, 9, 10, 12, 221/134; 340/825.35; 364/479; 235/381

[56] References Cited

U.S. PATENT DOCUMENTS 3,253,736 5/1966 Moyer ..... 221/6
4,458,802 7/1984 Maciver ..... 235/381
4,519,522 5/1985 McElwee ..... 364/479
4,598,810 7/1986 Shore et al. ..... 235/381

*Primary Examiner*—Jerry Smith
*Assistant Examiner*—Allen MacDonald
*Attorney, Agent, or Firm*—Finnegan, Henderson, Farabow, Garrett and Dunner

[57] ABSTRACT

A control system for a vending machine having a plurality of article storage bins mounted on a circulatory moving member includes discriminating devices associated respectively with the article storage bins for identifying the kinds of the articles stored respectively in the article storage bins and whether there are articles stored in the article storage bins, and a delivery control unit for controlling the delivery of a selected article based on information from the discriminating devices. Articles of many different kinds can be efficiently vended through a single article conveyor mechanism on a first-in first-out basis.

9 Claims, 18 Drawing Figures

FIG. 14

| ADDRESS | SOLD-OUT | SELECTION | ORDER | BIN NO. |
|---|---|---|---|---|
| $A_1$ | 1→0→1 | 1 | 1→2 | 1 |
| $A_2$ | 1→0→1 | 1 | 1→2 | 2 |
| $A_3$ | 1→0→1 | 1 | 1→2 | 3 |
| $A_4$ | 1 | 1 | 1 | 4 |
| $A_5$ | 1 | 1 | 1 | 5 |
| $A_6$ | 1 | 2 | 1→2 | 6 |
| $A_7$ | 1→0→1 | 2 | 1→2 | 7 |
| $A_8$ | 1→0→1 | 2 | 1 | 8 |
| $A_9$ | 1 | 2 | 1 | 9 |
| $A_{10}$ | 1 | 2 | 1 | 10 |
| $A_{11}$ | | | | |

FIG. 16

| ADDRESS | NOT USED | | ARTICLE | NOT USED | CODE | | | |
|---|---|---|---|---|---|---|---|---|
| | $b_7$ | $b_6$ | $b_5$ | $b_4$ | $b_3$ | $b_2$ | $b_1$ | $b_0$ |
| F 0 0 0 | | | 1 | | 0 | 0 | 0 | 1 |
| F 0 0 1 | | | 1 | | 0 | 0 | 0 | 1 |
| F 0 0 2 | | | 1 | | 0 | 0 | 1 | 1 |
| F 0 0 3 | | | 1 | | 0 | 0 | 1 | 1 |
| F 0 0 4 | | | 1 | | 0 | 0 | 1 | 1 |
| F 0 0 5 | | | 1 | | 0 | 0 | 1 | 0 |
| F 0 0 6 | | | 1 | | 0 | 0 | 1 | 0 |
| F 0 0 7 | | | 1 | | 0 | 0 | 1 | 0 |
| F 0 0 8 | | | 1 | | 0 | 0 | 0 | 1 |
| F 0 0 9 | | | 1 | | 0 | 0 | 0 | 1 |

FIG. 17

| ADDRESS | NOT USED | | ARTICLE | NOT USED | CODE | | | |
|---|---|---|---|---|---|---|---|---|
| | $b_7$ | $b_6$ | $b_5$ | $b_4$ | $b_3$ | $b_2$ | $b_1$ | $b_0$ |
| F 0 0 0 | | | 0 | | 0 | 0 | 1 | 1 |
| F 0 0 1 | | | 1 | | 0 | 0 | 1 | 1 |
| F 0 0 2 | | | 1 | | 0 | 0 | 1 | 1 |
| F 0 0 3 | | | 1 | | 0 | 0 | 1 | 0 |
| F 0 0 4 | | | 1 | | 0 | 0 | 1 | 0 |
| F 0 0 5 | | | 1 | | 0 | 0 | 1 | 0 |
| F 0 0 6 | | | 1 | | 0 | 0 | 0 | 1 |
| F 0 0 7 | | | 1 | | 0 | 0 | 0 | 1 |
| F 0 0 8 | | | 1 | | 0 | 0 | 0 | 1 |
| F 0 0 9 | | | 1 | | 0 | 0 | 0 | 1 |

CONTROL SYSTEM FOR A VENDING MACHINE USING ARTICLE FRESHNESS DATA

FIELD OF THE INVENTION

The present invention relates to a control system for a vending machine, and more particularly to a control system for a vending machine having an article conveyor mechanism composed of a plurality of article storage bins mounted on a circulatory moving member such as a chain or a belt for storing articles of different kinds in the article storage bins.

BACKGROUND OF THE INVENTION

Conventional vending machines have article conveyor mechanisms each designed for storing and conveying articles of one type only. In order to enable a single vending machine to vend different kinds of articles, the vending machine must incorporate as many article conveyor mechanisms as there are article types to be sold. Therefore, the prior vending machines capable of vending different articles have been large in size, a significant disadvantage when many different kinds of articles are to be sold in small quantities.

OBJECTS AND SUMMARY OF THE INVENTION

It is an object of the present invention to provide a control system for a vending machine capable of vending articles of many different kinds with a single article conveyor mechanism.

Another object of the present invention is to provide a control system for controlling a vending machine to shorten the time required after an article has been selected until the selected article is delivered.

Still another object of the present invention is to provide a control system for controlling a vending machine to vend articles sequentially in the same order that they were supplied, i.e., to vend articles in a first-in/first-out delivery sequence.

Additional objects and advantages of the present invention will be set forth in part in the description that follows and in part will be obvious from the description or may be learned by practice of the invention. The objects and advantages of the invention may be realized and obtained by the methods and apparatus particularly pointed out in the appended claims.

According to the present invention, a control system for a vending machine having a plurality of article storage bins mounted on a circulatory moving member includes discriminating means associated respectively with the article storage bins for identifying the kinds of the articles stored respectively in the article storage bins and whether there are articles stored in the article storage bins, and a delivery control means for controlling the delivery of a selected article based on information from the discriminating means, whereby articles of many different kinds can be vended through a single article conveyor mechanism.

The delivery control means has a readout and memory means for reading and storing the information from the discriminating means while moving the article storage bins in a circulatory manner, the delivery control means being operable for controlling the delivery of the selected article based on the information stored in the readout and memory means.

Items of information relating to the article storage bins are stored at addresses corresponding to storage bin positions, and the minimum number of article storage bins required to be moved for delivering the selected article is computed in each of the directions in which the article storage bins are moved on the basis of the items of information from the article storage bins and the addresses. By moving the article storage bins in the direction in which the computed number of article storage bins is smallest, the time required after the article has been selected until it is delivered is shortened.

Each time an article is supplied to an article storage bin, the data of the article storage bin is updated and the order of supply is stored, so that the articles can be delivered sequentially in the same order that they were supplied.

BRIEF DESCRIPTION OF THE DRAWINGS

The above and other objects, features and advantages of the present invention will become more apparent from the following description when viewed in conjunction with the accompanying drawings wherein:

FIG. 14 is a diagram showing a memory map in the control system illustrated in FIG. 6;

FIGS. 16 and 17 are diagrams showing a memory map in the control system of FIG. 15.

DESCRIPTION OF THE PREFERRED EMBODIMENT

Reference will now be made in detail to presently preferred embodiments of the invention, examples of which are illustrated in the accompanying drawings. Throughout the drawings, like referenced characters are used to designate like elements.

Figure 1:
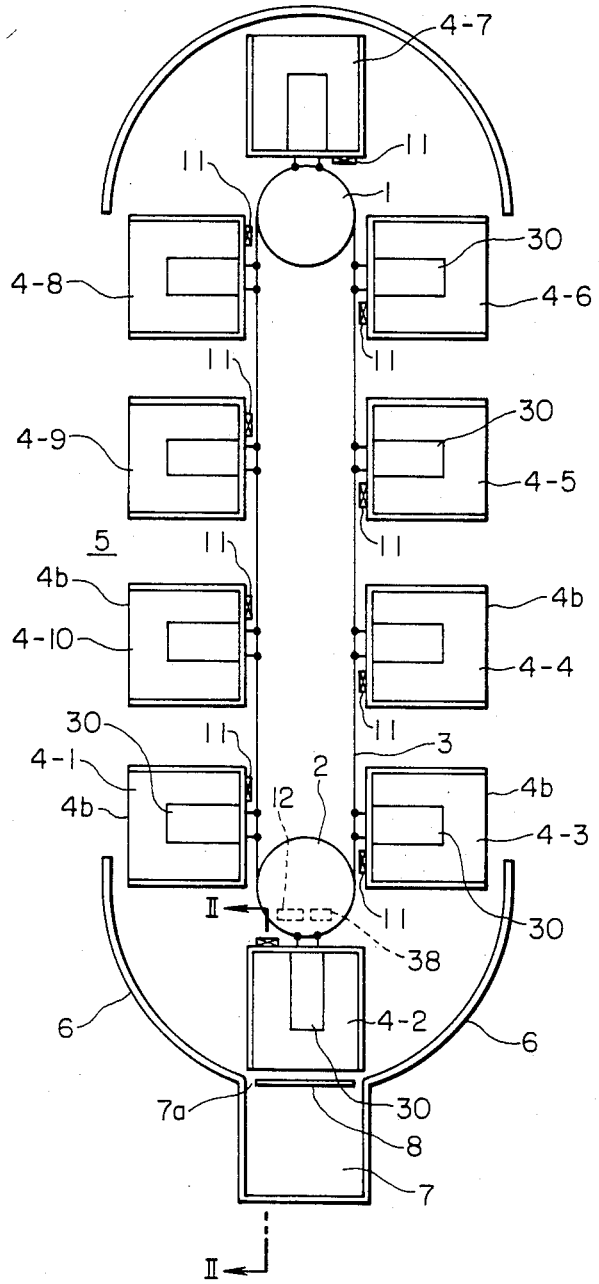
FIG. 1 is a front elevational view of a vending machine having an article conveyor mechanism in which the principles of the present invention are incorporated.

FIG. 1 shows a vending machine having an article conveyor mechanism 5 composed of endless chains 3 trained around a pair of vertically spaced sprockets 1, 2 rotatably supported on a frame (not shown). The chain 3 supports thereon a plurality (ten in the illustrated embodiment) of article storage bins 4-1, 4-2, . . . , 4-10 spaced at suitable intervals.

Each of the article storage bins 4 is of a box shape having a square cross section with a front open side 4*a* (FIG. 2) and an outer side partially open at 4*b*. A single article can be placed into and taken out of, each article storage bin 4 through the front open side 4*a*.

One of the sprockets 1 is operatively coupled to a motor (not shown) for moving the chains 3 in one direction or the other to convey the article storage bins 4 in a circulating manner in response to energization of the motor.

A semicircular arcuate guide 6 is disposed below the article conveyor mechanism 5 and extends along a passage followed by the outer edges of the article storage bins 4 as they are conveyed. The arcuate guide 6 includes an article receiving container 7 disposed in a central lower position and having a rectangular front elevational shape with an upper opening *7a*. A flat openable plate 8 pivotally supported at one end on a pivot pin 10 is positioned in the upper opening *7a*, the flat openable plate 8 being tiltable about the pivot pin 10 to have the opposite end lowered in an article pickup hole 9 (FIG. 2).

If the openable plate 8 is kept horizontal while the article storage bins 4 are conveyed in the circulating path, then an article will not be discharged from the article storage bin 4 which has reached the lowermost position indicated by 4-2 in FIG. 1, but will continuously be moved along the arcuate guide 6. If the flat openable plate 8 is tilted to the dot-dot-and-dash-line position shown in FIG. 2, then the article will drop out of the article storage bin 4 into the article receiving container 7 when the article storage bin 4 reaches the lowermost position 4-2.

Figure 3:
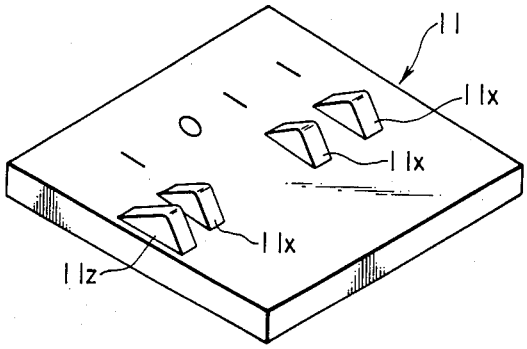
FIG. 3 is a perspective view of a code plate.

Each of the article storage bins 4 supports on its side panel facing the chains 3 a code plate 11 having projections corresponding to a plural-bit code indicative of the kind of article stored in the article storage bin and an article selector switch. As shown in FIG. 3, the code plate 11 has projections 11X corresponding to 1*s* (the value "1") of the 4-bit code, there being no projection corresponding to a 0 of the 4-bit code. A code discriminator 12 (FIG. 1) is disposed adjacent to the lower sprocket 2 for being actuated by the projections 11X of the code plate 11. The code plate 11 also has a projection 11Z for detecting an article storage bin.

Figure 2:
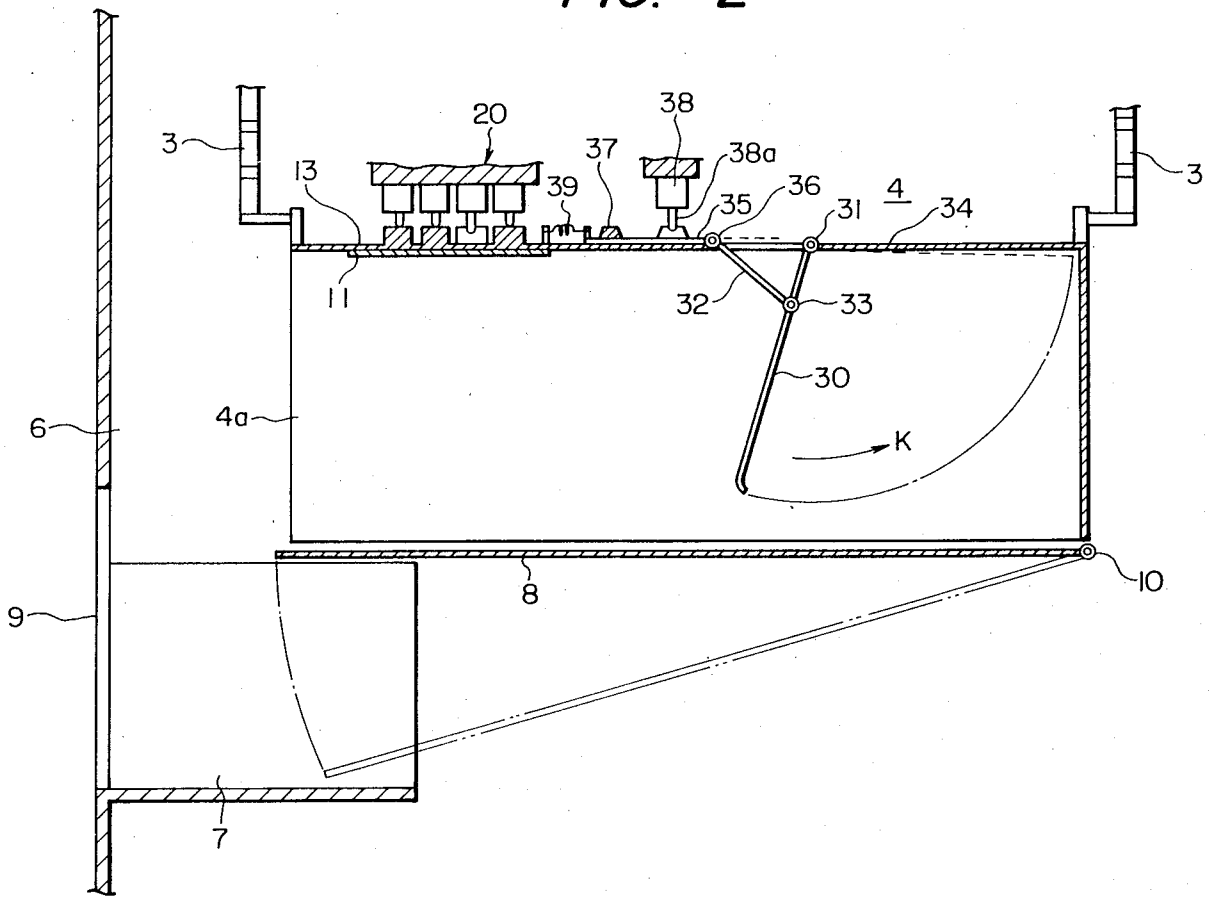
FIG. 2 is an enlarged cross-sectional view taken along line II—II of FIG. 1.

As shown in FIG. 2, the code plate 11 is attached to the article storage bin 4 with the projections 11X, 11Z projecting out through a square hole 13 defined in the side panel facing the chains 3. The code plates 11 may be attached in other positions, e.g., they may be attached to the chains 3 corresponding to the respective article storage bins 4.

Figure 4:
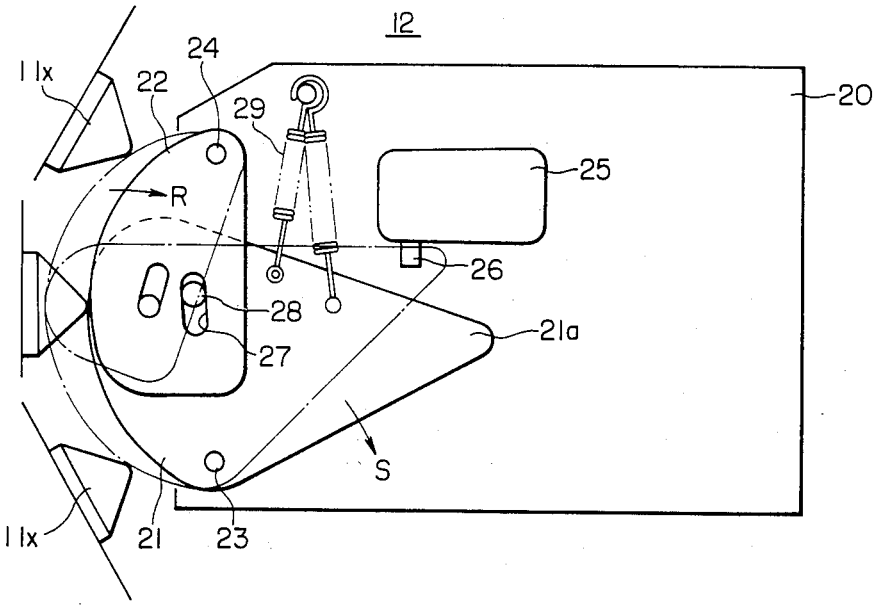
FIG. 4 is a side elevational view of a code discriminator.
Figure 5:
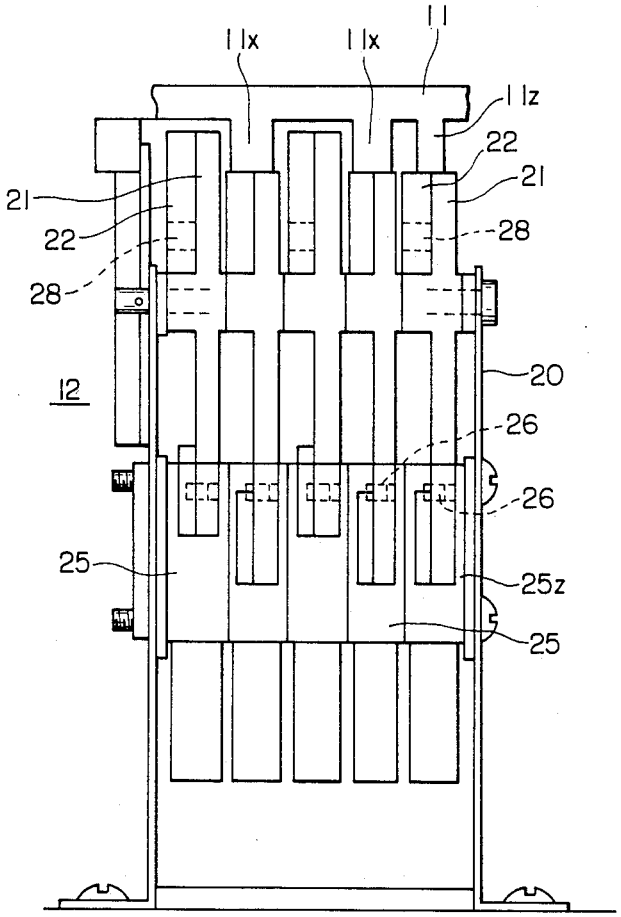
FIG. 5 is a front elevational view of the code discriminator shown in FIG. 4.

As shown in FIGS. 4 and 5, the code discriminator 12 is composed of a fixed frame 20, first sectorial cam plates 21 having arcuate edges and pivotally mounted by pivot pins 23 on the fixed frame 20, and second cam plates 22 having arcuate edges and pivotally mounted by pivot pins 24 on the fixed frame 20. The arcuate edges of the first and second cam plates 21, 22 are disposed for contact with the projections of the code plates 11. The first cam plates 21 have free ends 21*a* movable into and out of engagement with the actuating members 26 of microswitches 25 serving as article code detector switches. Each of the first cam plates 21 has a slot 27 in which there is slidably engaged a pin 28 projecting from the associated second ca plate 22 so that the turning movement of the second cam plate 22 will be transmitted to the first cam plate 21.

The first cam plates 21 are normally urged by springs 29 in a direction toward the article code detector switches 25. When the projections 11X of the code plate 25 are not held in abutment against the first cam plates 21, the free ends 21*a* of the first cam plates 21 press the actuating members 26 of the article code detector switches 25.

As shown in FIG. 5, the code discriminator 12 includes five first cam plates 21, five second cam plates 22, and five article code detector switches 25. The first cam plates 21 and the second cam plates 22 engage the projections of the code plates 11 no matter whether the article storage bins 4 turn clockwise or counterclockwise in FIG. 1 for operating the article code detector switches 25.

In FIGS. 1 and 2, an article detector plate 30 is supported on each article storage bin 4 for angular movement therein about a pivot pin 31. To the article detector plate 30, there is coupled by a pivot pin 33 a connector arm 32 extending through an elongate slot 34 defined in the side panel of the article storage bin 4 facing the chains 3. The connector arm 32 projects through the slot 34 out of the article storage bin 4 and is coupled by a pivot pin 36 to a slide plate 35 slidably disposed on the side panel of the article storage bin 4. The slide plate 35 has a cam 37 projecting therefrom, and a limit switch 38 serving as a sold-out detector switch is fixed to the frame in a position aligned with the cam 37.

A spring 39 acts between the article storage bin 4 and the slide plate 35 for normally urging the slide plate 35 to move in a direction toward the article pickup hole 9. When no article is in the article storage bin 4, the article detector plate 30 is directed into the article storage bin 4 and the cam 37 is positioned out of engagement with the sold-out detector switch 38. When an article is pushed through the front opening 4*a* into the article storage bin 4, the article detector plate 30 is turned by the article in the direction of the arrow K to cause the connector arm 32 to move the slide plate 35 toward the sold-out detector switch 38 against the tension of the spring 39. The cam 37 then engages the actuating member 38*a* of the sold-out detector switch 38 to turn on the same.

Figure 6:
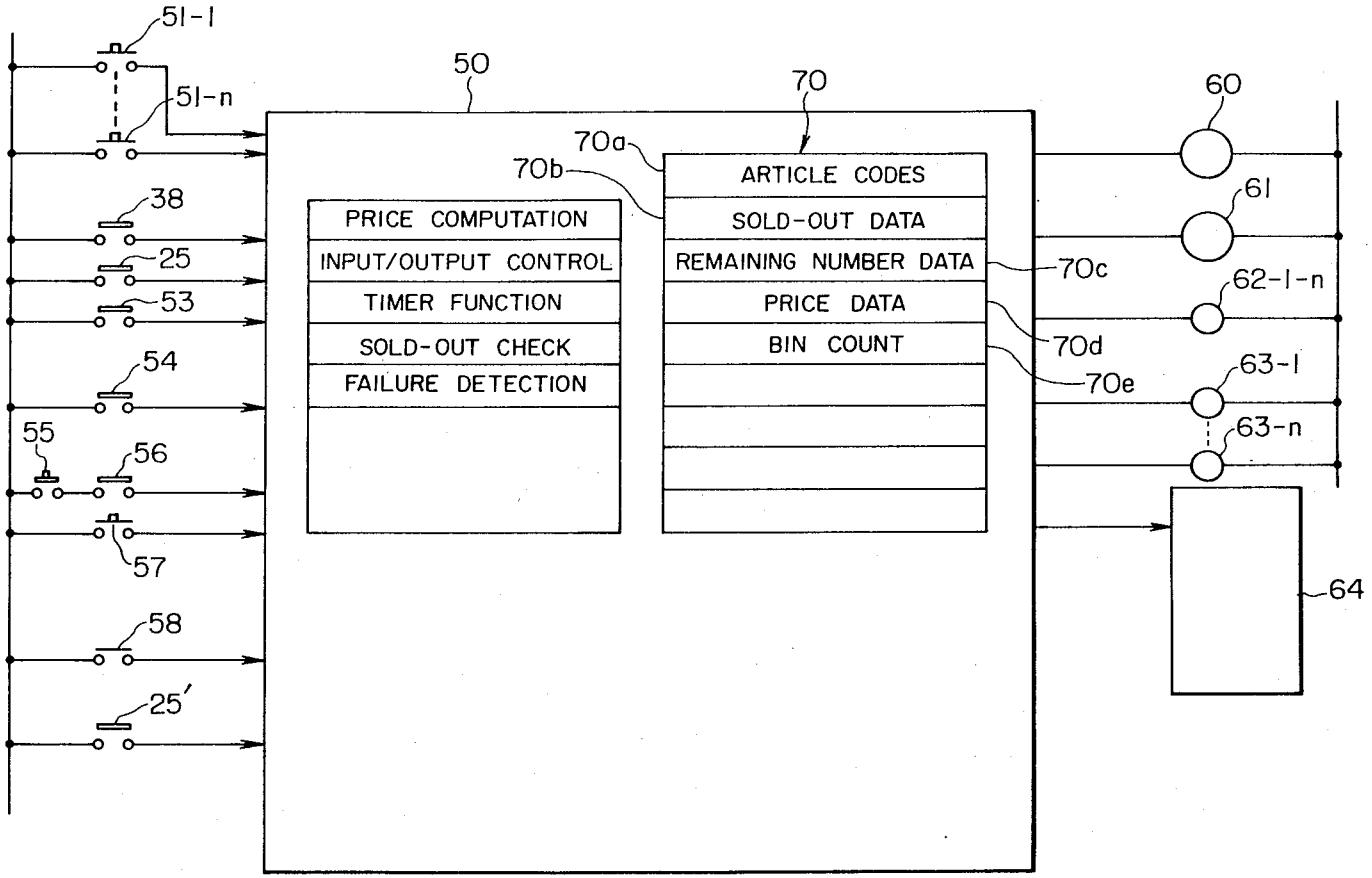
FIG. 6 is a block diagram of a control system according to an embodiment of the present invention.

FIG. 6 shows a control system having a control circuit 50 composed of a microcomputer, a plurality of article selector switches 51-1 through 51-*n* corresponding to article types, the sold-out detector switch 38, and the article code detector switch 25. Although there are four parallel article code detector switches 25, only one of them is shown in FIG. 6.

The control system also has a bin detector switch 53 composed of one of the switches of the code discriminator 12. Each time the article storage bin 4 moves past the code discriminator 12, the projection 11Z of the code plate 11 turns on the bin detector switch 53.

The control system further includes a switch 54 for preventing two articles from being vended simultaneously, a set switch 55 for instructing the control circuit 50 to scan the article storage bins 4 in order to register the article types in a memory in the control circuit 50 after the articles have been stored in the respective article storage bins 4 by the operator, a door switch 56 for detecting whether the door of the vending machine is opened or not, a loading switch 57 used when loading one article into each article storage bin 4, and a mode setting switch 58.

The control system also has a motor 60 for rotating the sprocket 1 to deliver the article storage bins 4 in a circulating manner, a motor or solenoid 61 for actuating the openable plate 8, sale-permit indicator lamps 62$\beta$-1 through 62$\beta$-n disposed on the front panel of the vending machine for the respective article types, sold-out indicator lamps 63-1 through 63-*n* disposed on the front panel of the vending machine for the respective article types, and as many circulation indicator lamps 64 as the number of article storage bins 4 for indicating that the article storage bins 4 are moved in circulation. Each of the circulation indicator lamps 64 is energizable when the corresponding article storage bin 4 moves past a prescribed position, i.e., a position over the article receiving container 7.

The vending machine has a coin processing unit (not shown) of a conventional construction for counting inserted coins.

Figure 7:
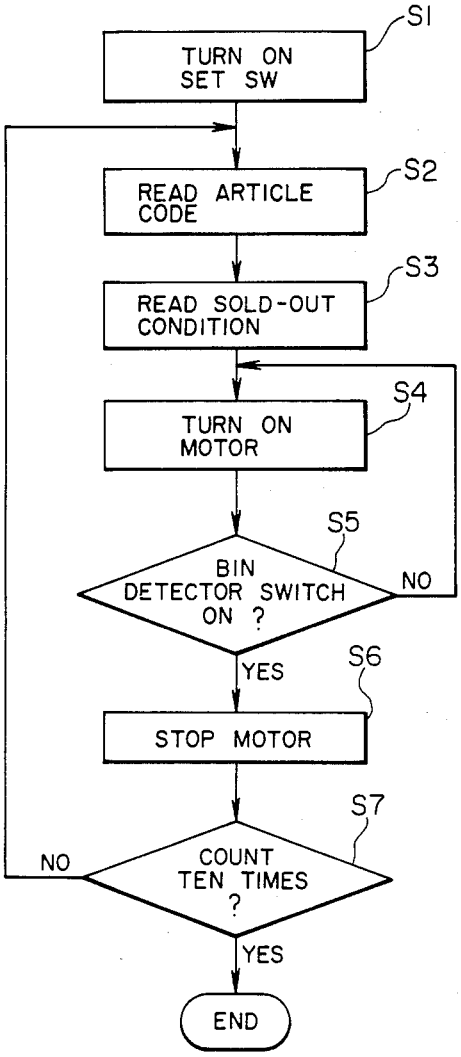
FIGS. 7 through 9 are flowcharts of the operation of the control system shown in FIG. 6.
Figure 9:
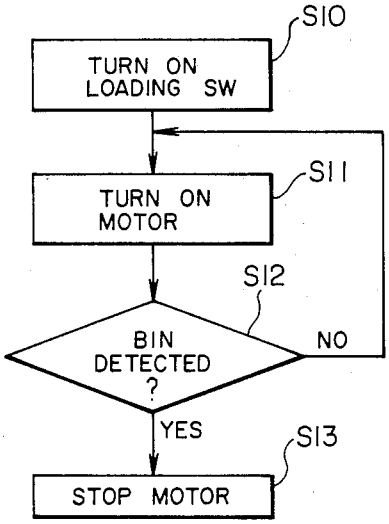
Figure 8:
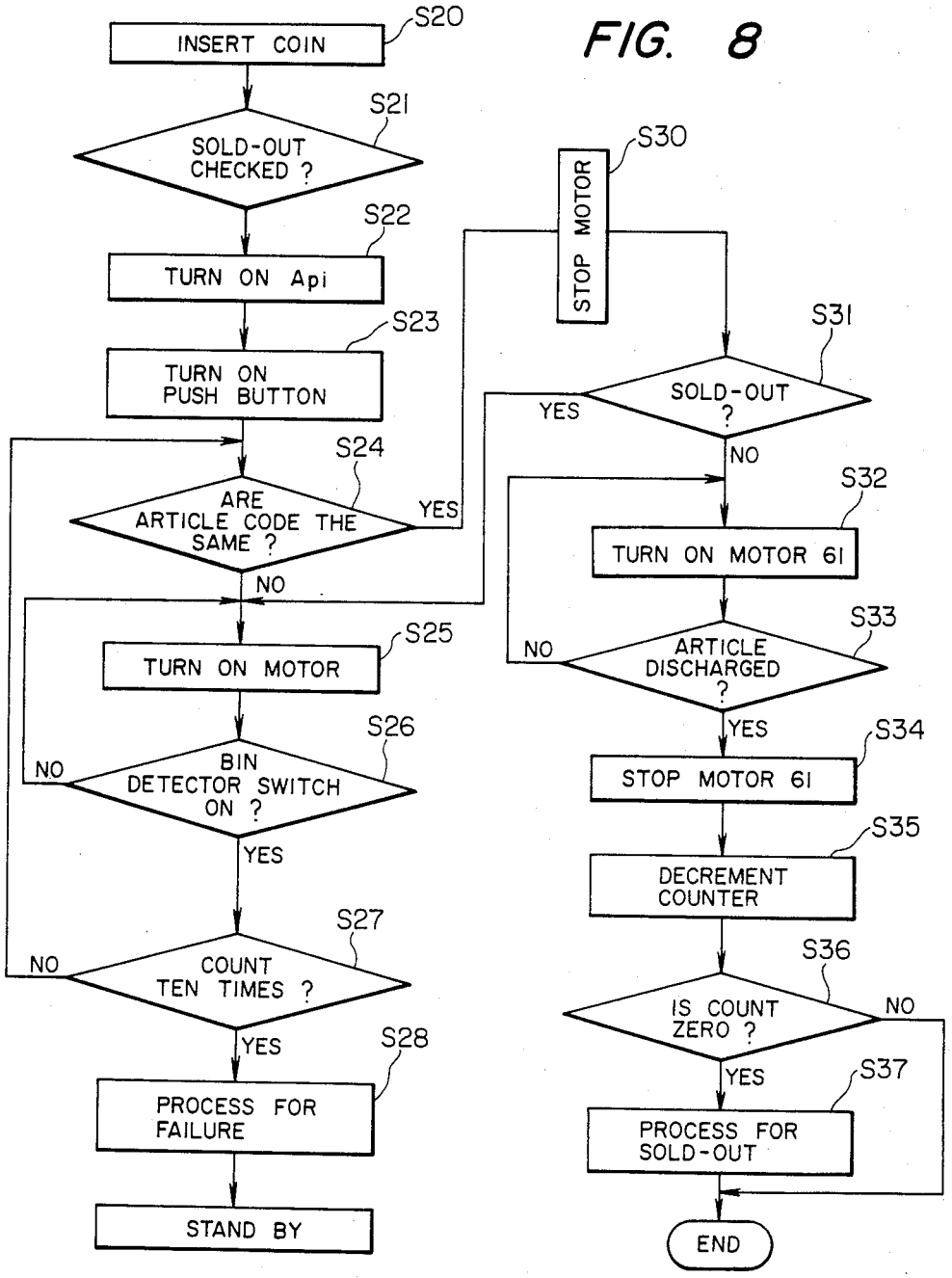

The control circuit 50 stores in its memory a control program necessary for vending the articles, such as a program for processing inserted coins, and a program shown in FIGS. 7 through 9 for controlling the article conveyor mechanism 5. The control circuit 50 has a memory 70 for storing various data items as illustrated in FIG. 6.

Each of the article storage bins 4 may bear letters or symbols representing the article stored therein.

Operation of the vending machine thus constructed is as follows:

Loading of articles:

Articles A of the first type are to be stored in the article storage bins 4-1 through 4-5, and articles B of the second type are to be stored in the article storage bins 4-6 through 4-10 for sale.

Code plates 11 each bearing a binary code "0001" ("1" in the decimal notation) corresponding to the first article type are attached as by screws to the side panels of the article storage bins 4-1 through 4-5, with the projections projecting through the hole 13, as shown in FIG. 2. Other code plates 11 each bearing a binary code "0010" ("2" in the decimal notation) corresponding to the second article type are similarly attached to the side panels of the article storage bins 4-6 through 4-10. These codes correspond respectively to the article selector switches 51-1 and 51-2, respectively. For different article types, code plates having codes corresponding to those article types are also attached to the article storage bins.

Loading of the articles into the respective article storage bins will be described with reference to FIG. 9. The loading switch 57 is closed in step S10 to rotate the motor 60 in a step S11 to start the circulation of the article storage bins. When the article storage bin 4-3, for example, reaches the position over the article receiving container 7, the projection 11Z on the code plate 11 mounted on the article storage bin 4-3 turns on the corresponding microwsitch (bin detector switch) 53 of the code discriminator 12 to detect the article storag bin 4-3 in step S12. The program then goes to step S13 in which the motor 60 is de-energized. The article is then manually loaded through the front opening **4*a* into the article storage bin 4-3, and thereafter the loading switch 57 is turned on again. Control is then returned to step S10 to start the motor 60 for moving the chains 3 to bring the next article storage bin 4-4 to the position over the article receiving container 7**.

The above cycle of operation is repeated ten times to successively load the articles into the respective article storage bins 4-1 through 4-10.

When the article is loaded into each article storage bin through the front opening **4*a*, the article detector plate 30 is pushed in the direction of the arrow K to slide the slide plate 35 to the right in FIG. 2**.

Reading of articles:

When the door of the vending machine is closed to turn on the door switch 56, and then the set switch 55 is turned on, the program illustrated in FIG. 7 is executed by the control circuit 50 to write the codes indicating the articles types in the article storage bins into an area **70*a* of the memory 70 and also to write sold-out data into an area 70*b* of the memory 70**.

More specifically, when the motor 60 is rotated to circulate the article storage bins, the code plates 11 are successively moved past the code discriminator 12 to cause the article code detector switches 25 to issue successive 4-bit code signals dependent on whether there are projections 11X on the code plates 11, and also cause the sold-out detector switch 38 to issue successive signals indicating whether there are articles or not in the article storage bins.

The code signals are stored as information indicating article types in the memory area **70*a*, and the sold-out data 70*b* is stored into the memory area 70*b* for the respective article storage bins, when the bin detector switch 53 detects the article storage bins (i.e., projections 11Z**) successively.

The code discriminator 12 operates as follows:

When the article storage bin 4 reaches the position over the article receiving container 7, and the code plate 11 having projections 11X, 11Z as shown in FIG. 3 reaches the code discriminator 12, with the projection 11X moving from the left to the right in FIG. 4, the projection 11X engages the second cam plate 22 to turn the same in the direction of the arrow R for causing the pin 28 to push and turn the first cam plate 21 in the direction of the arrow S. Therefore, the article code detector switch 25 is turned off to issue a binary signal "1".

If there is no projection 11X, then the first and second cam plates 21, 22 are positioned as indicated by the dot-and-dash lines in FIG. 4 to keep the microswitch 25 turned on and issuing a binary signal "0".

Therefore, the code discriminator 12 issues a prescribed code signal.

In FIG. 7, if the bin detector switch 53 is turned on in step S5, then the motor 60 is de-energized in step S6. The program then goes to step S7 which detects whether or not a count counted by a memory area **70*e* reaches ten (corresponding to the maximum bin number of 10). If ten is not reached in step S7, then control returns to step S2 in which the article code from the article code detector switches 25 is read into the memory area 70*a*. Then, the condition of whether the article is sold out or not is detected by the sold-out detector switch 38 and read into the memory area 70*b* in step S3. The motor 60 is then energized in step S4** to circulate the article storage bins.

The above cycle is repeated ten times to register the article types in the respective article storage bins, whereupon the motor 60 is de-energized.

After the above operation has been completed, the numbers of the articles of different types are computed from the data stored in the memory areas **70*a*, 70*b* and stored into a memory area 70*c***.

To prevent the above reading operation from being forgotten, the sold-out indicator lamps 62 are kept energized until the set switch 55 is operated.

At the same time that the article codes are written into the memory **70*a*, the prices of the article types are also written into a memory area 70*d*** through a ten-key pad or the like.

Selling of articles:

Operation to sell articles will be described with reference to FIG. 8. When coins amounting to a prescribed sum of money have been deposited in step S20, a step S21 ascertains whether the articles have been sold out based on the data stored in the memory 70c, and sale-permit indicator lamps 63 (indicated by Api in FIG. 8) are energized to indicate vendible articles.

When the customer depresses the article selector switch 51 corresponding to the desired article, and if the selected article is salable, the program proceeds to step S24 in which the article code of the article storage bin as read by the article code detector switches 25 of the code discriminator 12 and the article code specified by the article selector switch are compared by the control circuit 50.

If the article code of the article storage bin and the article code specified by the article selector switch do not coincide with each other, then control goes to step S25 which operates the motor 60 to circulate the article storage bins 4. Then, step S26 ascertains whether the bin detector switch 53 is turned on or not. If the bin detector switch 53 is turned on by the next article storage bin reaching the code discriminator 12, then the program goes to step S27 which determines how many article storage bins have moved past the code discriminator 12. If less than ten article storage bins as counted by the memory area 70e have passed, then the program goes back to step S24 to repeat the above routine so that the article storage bins will be continuously circulated until the article storage bin bearing the desired article code is positioned over the article receiving container 7.

While the article storage bins are successively circulated, the motor or solenoid 61 remains de-energized and hence the openable plate 8 remains lifted. Therefore, the articles in the article storage bins are moved along the openable plate 8 and the guide 6 to keep on circulating the article storage bins.

If the article code on the code plate 11 and the article code given by the article selector switch 51 coincide with each other in step S24, then control goes to step S30 to stop the motor 60 and ascertains in step S31 whether there is an article in the lowermost article storage bin, i.e., if the article has been sold out in that article storage bin, based on the signal from the sold-out detector switch 38. If not sold out, then the program goes to step S32 to energize the motor or solenoid 61 to tilt the openable plate 8 downwardly to the two-dot-and-dash-line position as shown in FIG. 2. The article is then gravity-fed down the plate 8 into the article receiving container 7, from which the article can now be taken out through the article pickup hole 9.

When the article drops into the article receiving container 7, the slide plate 35 is pulled under the tension of the spring 39 to return the cam 37 to the position shown hatched in FIG. 2. The article detector plate 30 is turned downwardly in the direction opposite to the direction of the arrow K.

If the article is taken out of the article pickup hole 9, a self-driven cam coacting with the motor 61 issues a signal to indicate that the article has been discharged in step S33 and to de-energize the motor 61 in step 34 whereupon the openable plate 8 is lifted back to the closed position.

Then, step S35 decrements by 1 the number of the articles stored in the memory area 70c corresponding to the article that has been discharged. Step S36 ascertains whether the remaining number is 0 or not. If the remaining number is 0, then the articles are all sold out, and if not, the control circuit is brought into readiness for a next vending operation. If the articles have all been sold out, the corresponding sold-out indicator lamp 62 is energized.

When the articles have been sold out, the corresponding sale-permit indicator lamp 63 will not be energized even if coins are inserted.

If there is no article in the article storage bin, i.e., the article has been sold out, in step S31, the program returns to step S25, and the article storage bins are continuously circulated until another article storage bin is positioned over the article receiving container 7.

As the article storage bins are circulating during the above operation, the circulation indicator lamps 64 are successively energized one by one to let the customer know that the article storage bins are circulating.

Figure 10:
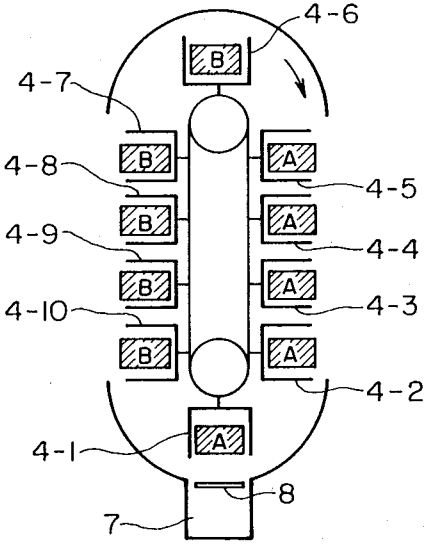

When three articles A are vended and two articles B are vended after the articles A have been loaded into the article storage bins 4-1 through 4-5 and the articles B have been loaded into the article storage bins 4-6 through 4-10 as shown in FIG. 10, the article storage bins are rotated in the direction of the arrow, and the articles A are discharged successively from the article storage bins 4-1, 4-2, 4-3 and the articles B are discharged successively from the article storage bins 4-6, 4-7, so that the article storage bins 4-1, 4-2, 4-3, 4-6, 4-7 are emptied while the other article storage bins are loaded with articles. When the empty article storage bins are supplied with articles, all of the article storage bins are loaded again as illustrated in FIG. 10. Thereafter, articles are vended or discharged again successively from the article storage bins in the order in which they are arranged.

As the articles are vended and supplied repeatedly, the articles in certain article storage bins such as 4-5, 4-10 tend to remain unsold unless all of the articles are vended. This is disadvantageous especially when articles which are liable to spoil such as milk, are to be vended by the vending machine. A means for solving this problem will be described below.

As shown in FIG. 6, a microswitch (a bin number detector switch) 25' for detecting a bin number is added to the control system. There are four microswitches corresponding to four bits, as with the article code detector switches 25, for issuing numbers (1 through 10) representing the article storage bins 4-1 through 4-10. According to the present invention, the data items stored in the memory areas 70a, 70b are as shown in the memory map of FIG. 14.

In FIG. 14, the memory 70 stores in its addresses $A_1$ through $A_{10}$ various data items related to the articles in the article storage bins 4-1 through 4-10, i.e., whether the articles are sold out or not, the types of the articles in the article storage bins and the selections (or article codes) indicating which article selector switches 51 the article types correspond to, the order in which the articles are supplied, and the bin numbers. The stored data items shown in FIG. 14 indicate that there are ten article storage bins and there are two article types, for example. The memory 70 is backed up by a battery.

Figure 12:
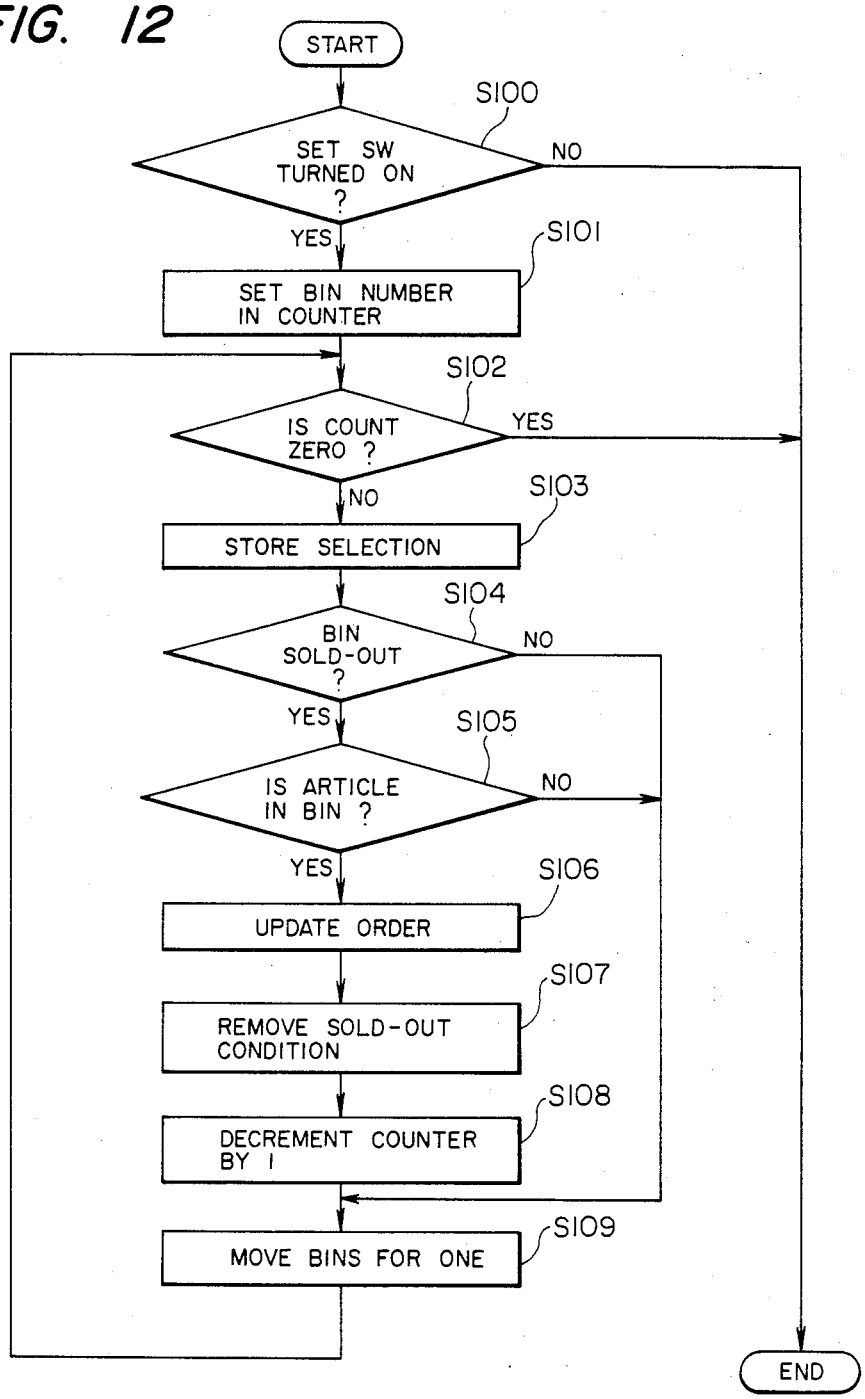
FIGS. 12 and 13 are flowcharts of the operation of the control system of FIG. 6.
Figure 13:
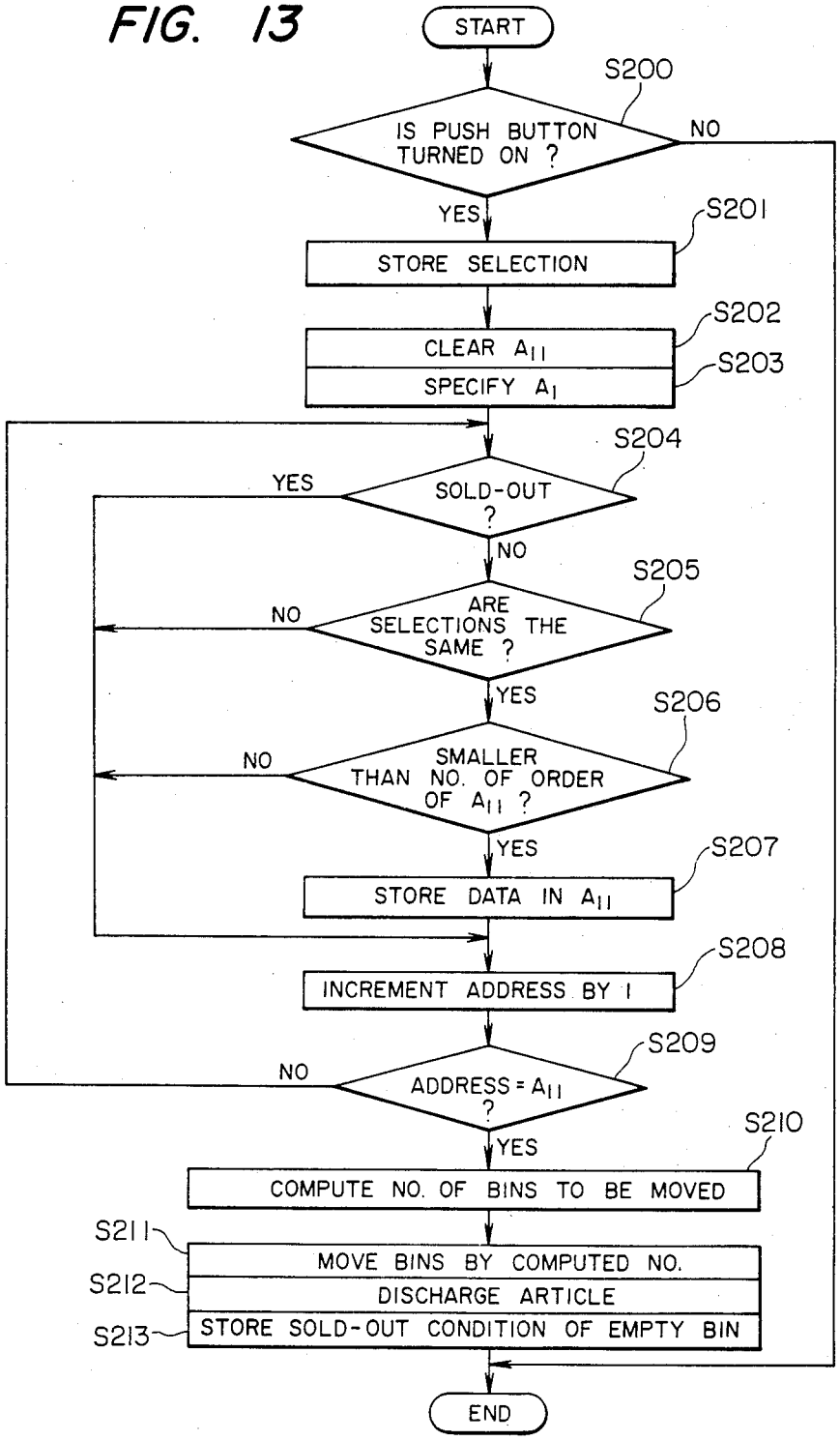

Operation of the above embodiment of the present invention will be described with reference to FIGS. 12 and 13. FIG. 12 is a flowchart showing an operation program to be executed when the set switch 55 is operated after an article has been supplied, and FIG. 13 is a flowchart showing a vending operation program.

When the vending machine is first switched on, the bin numbers 1 through 10 are stored respectively in the bin number storage sections of the addresses $A_1$ through $A_{10}$ of FIG. 14, while any other stored data items are cleared.

As illustrated in FIG. 12, step S100 determines whether the set switch 55 is operated or not, and if operated, the program goes to step S101 which sets the number of the article storage bins (10 in FIG. 1) into the memory area 70*e*. Control then goes to step S102 which ascertains whether the data stored in the memory area 70*e* is zero or not. If not zero, the program proceeds to step S103 in which the code of an article is read from the switches 25, the bin number is read from the switches 25', and the article code stored in the selection storage section in FIG. 14 which corresponds to the read bin number, i.e., the code corresponding to the number of the selector switch 51, is stored. Then, step S104 ascertains whether the article in the article storage bin in question has been sold out or not based on the data stored in the sold-out storage section of FIG. 14 which corresponds to the bin number that has been read in step S103. If sold out, then the program goes to step S105, and if not, then the program goes to step S109.

Step S105 ascertains if there is an article or the article is sold out in the article storage bin (indicated by the bin number read in the step S103) based on the signal from the sold-out detector switch 38. If sold out, then control goes to step S109, and if not, control goes to step 106. Step S106 increments by 1 the data stored in the order storage section of FIG. 14 which corresponds to the bin number read in step S103, and then the program goes to step S107. Step S107 changes the data in the sold-out storage section in FIG. 14 which correspond to the same bin number to non-sold-out status data. The program then proceeds to step S108 which decrements the data in the memory area 70*e* by 1, and then goes to step S109. Step S109 moves the article storage bins 4 by one bin-to-bin interval, and then the program returns to step S102 and is repeated until the data stored in the memory area 70*e* is reduced to zero.

In FIG. 13, step S200 ascertains whether a selector switch 51 for an article which can be vended (as verified by the fact that the inserted amount of money is sufficient and the article has not been sold out) is depressed or not. If depressed, the program goes to step S201 which stores the number of the selector switch depressed in step S200, i.e., the code corresponding to the selection of FIG. 14) into a prescribed address in the memory 70. Control goes to step S202 which clears the data in the address $A_{11}$ of FIG. 14, and thereafter goes to step S203. Step S203 specifies the memory address $A_1$ shown in FIG. 14.

Step S204 ascertains whether the article is sold out or not based on the data of FIG. 14 which is stored in the address specified in step S203 or step S208. If sold out, the program goes to step S208, and if not, the program goes to step S205. Stop S205 determines whether the selection stored in the address specified as above coincides with the selection stored in step S201. If they coincide with each other, then the program proceeds to step S206, and if not, then the program goes to step S208. Step S206 ascertains whether the number of order stored in the address specified as above is smaller than the number of order (which will be stored in a subsequent step S207) stored in the address $A_{11}$. If smaller, then the program goes to step S207, and if not, then the program goes to step S208.

If no number of order is stored in the address $A_{11}$, i.e., the number of order stored in the address $A_{11}$ is zero, the program goes directly to step S207. Step S207 stores the data in the address specified as above into the address $A_{11}$, and the program goes to step S208. Step S208 increments the address specified thus far by 1 (e.g., if the address $A_1$ has been specified thus far, then the address $A_2$ is now specified), and the program goes to step S209. Step S209 ascertains whether the address specified in step S208 is $A_{11}$. If $A_{11}$, then control goes to step S210, and if not, then control returns to step S204. Provided the program goes to step S210, the article in the article storage bin stored in address $A_{11}$ is the one supplied earlier among the selected articles. Step S210 reads the signal from the switches 25', detects the number of the bin positioned over the article receiving container 7, and computes the number of article storage bins to be moved for discharging the article in the article storage bin stored in the address $A_{11}$.

The program then proceeds to step S211 which energizes the motor 60 to move the article storage bins for an interval corresponding to the number of bins as computed in step S210. Thereafter, the program performs step S212 in which the motor or solenoid 61 is energized to discharge the article, and then goes to step S213. Step S213 stores 0 value indicating the sold-out condition in the memory location that corresponds to the article storage bin from which the article has been discharged. The detection of movement of the article storage bins 4 and the subtraction from the number of remaining articles are computed in the same manner as conventional systems.

Figure 11:
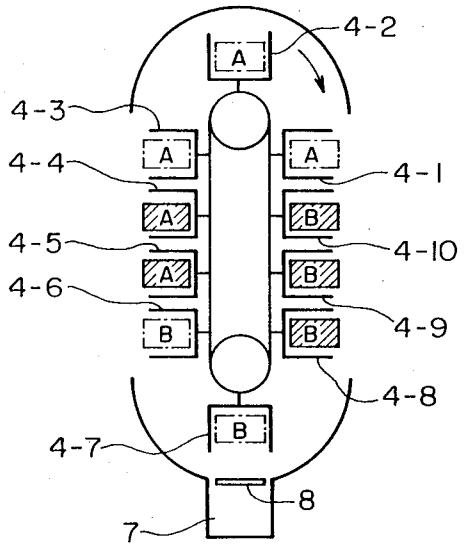
FIGS. 10 and 11 are schematic views illustrative of the operation of the vending machine of FIG. 1.

It is now assumed that after the articles A (article code 1) and the articles B (article code 2) have been supplied as shown in FIG. 10, three articles A and two articles B are sold as shown in FIG. 11, and then articles are supplied again shown in FIG. 10. Such an operation will be described in detail below.

After the articles have been supplied as shown in FIG. 10, if the set switch 55 is operated, then the selection of FIG. 14 is set to "1" for the bin numbers 1 through 5 and to "2" for the bin numbers 6 through 10 in step S103 of FIG. 12. Step S107 changes the sold-out condition to "1" to indicate the non-sold-out condition for all of the bin numbers. Step S106 sets all of the numbers of turn, i.e., selection order, in FIG. 14 to "1". Thereafter, when three articles A and two articles B are vended, the sold-out condition of FIG. 14 is set to "0" indicating that the articles for the bin numbers 1, 2, 3, 7, 8 are sold out, in step S213 of FIG. 13. When articles are resupplied, the numbers of order corresponding to the bin numbers 1, 2, 3, 7, 8 (for which the articles are sold out) are updated to "2" in step S106 of FIG. 12. Therefore, an article A which will be discharged in a next vending cycle is from the article storage bin bearing the bin number 4 having a smaller number of turn in FIG. 14, and an article B which will be discharged in a next vending cycle is from the article storage bin bearing the bin number 8. When article storage bins are subsequently resupplied with articles at different times, the numbers of turn in FIG. 14 are the same 2, but an article is discharged from an article storage bin having a smaller bin number. As a consequence, the articles are discharged in a first-in/first-out sequence.

While in the above embodiment the frequency of supply of articles to each article storage bin is stored as the number of order of FIG. 14 to determine an article which has been supplied earlier, the date and time at which the article is supplied may be stored instead. With such an alternative, a timekeeping mechanism is incorporated in the control system 50, and the time is read from the timekeeping mechanism (in step S106 of FIG. 12) upon supplying an article and stored as the number of turn of FIG. 14. Where no such timekeeping mechanism is incorporated, the date and time may be set by switches when an article is manually supplied, and may be stored in step S106. As an alternative to the frequency of supply of articles to each article storage bin, the frequency of supply to the vending machine (i.e., the frequency of-operation of the set switch 55) may be counted and stored as the number of order of FIG. 14 in step S106. In summary, the data to be stored as the number of order of FIG. 14 is such data as will indicate the order in which the articles has been supplied.

While in the foregoing embodiment the bin number is detected by the bin number detector switches 25' for each article storage bin, only the article storage bin bearing the bin number 1 may be detected by a 1-bit switch 25', and the bin numbers of any other article storage bins positioned above the article receiving container 7 maybe determined by counting the bin numbers based on the signal from the bin detector switch 53 after the bin number 1 has been detected by the switch 25'.

FIG. 5 shows in a block form a control system according to another embodiment of the present invention for controlling the vending machine illustrated in FIGS. 1 through 5.

Figure 15:
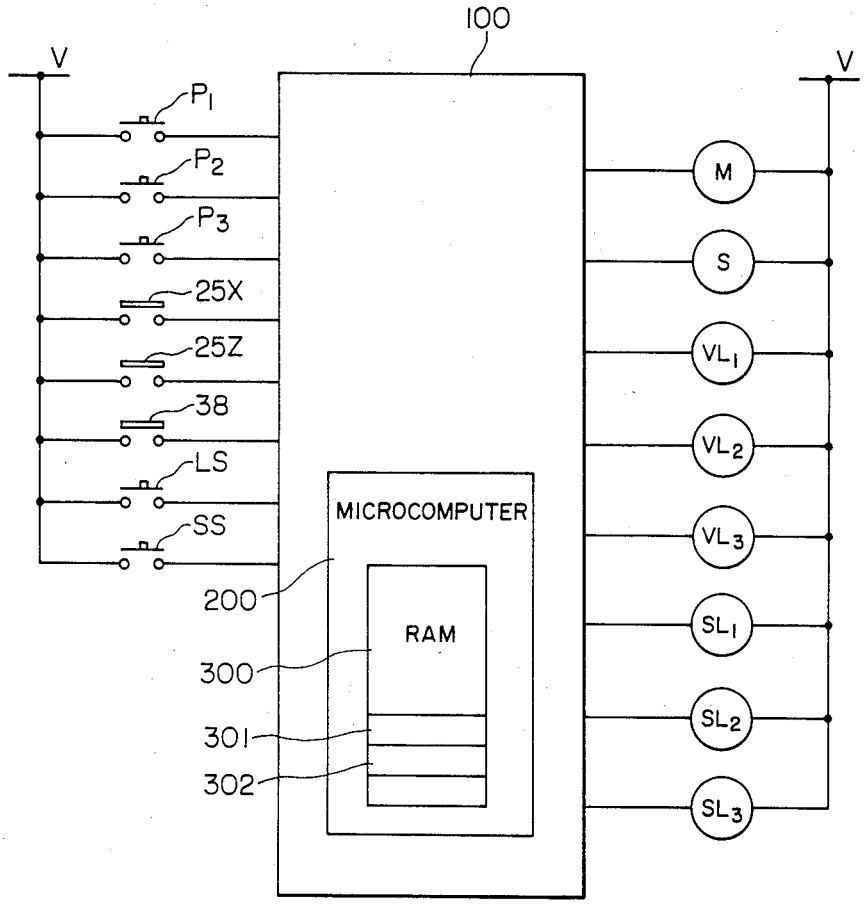
FIG. 15 is a block diagram of a control system according to another embodiment of the present invention.

The control system of FIG. 15 includes a control unit 100 having a microcomputer 200 and a RAM (random-access memory) 300 for storing control data and other data. A reversible motor M is coupled to the sprocket 1 for circulating the article storage bins. A solenoid S serves to tilt the openable plate 8 to the dot-and-dash-line position of FIG. 2 for allowing the article to drop from the article storage bin 4 located in the lowermost article discharge position over the article receiving container 7 into the article receiving container 7. Denoted at $VL_1$ through $VL_3$ are sale-permit indicator lamps for respective article types; $SL_1$ through $SL_3$ are sold-out indicator lamps for respective article types; and $P_1$ through $P_3$ are article selector switches for respective article types. Four code detector switches 25X are provided for detecting the projections 11X on the code plate 11, and a bin detector switch 25Z is provided for detecting the projection 11Z on the code plate 11. The system also includes a loafing switch LS which is depressed when circulating the article storage bins 4 for each bin-to-bin interval in order to supply an article to each article storage bin through the front opening thereof, a set switch 55 which is depressed after articles have been supplied to store article codes for all of the article storage bins, and a switch 38 for detecting whether there is an article in an article storage bin.

In this embodiment, three article types are available for sale. Articles of a first type (code "0001" for example) are stored in the article storage bins 4-1 through 4-5, articles of a second type (code "0010" for example) are stored in the article storage bins 4-5 through 4-7, and articles of a third type (code "0011" for example) are stored in the article storage bins 4-8 through 4-10. The code plates bearing these article type codes are attached to the respective article storage bins.

The selector switch $P_1$, the sale-permit indicator lamp $VL_1$, and the sold-out indicator lamp $SL_1$ correspond to the article storage bins on which the code plates of the code "0001" are mounted. The selector switch $P_2$, the sale-permit indicator lamp $VL_2$, and the sold-out indicator lamp $SL_2$ correspond to the article storage bins on which the code plates of the code "0010" are mounted. The selector switch $P_3$, the sale-permit indicator lamp $VL_3$, and the sold-out indicator lamp $SL_3$ correspond to the article storage bins on which the code plates of the code "0011" are mounted.

FIGS. 16 and 17 are illustrative of RAM maps showing a major area of the RAM 300, each address being composed of eight bits (one byte) $b_0$ through $b_7$. Data for respective article storage bins are stored in addresses F000 through F009 in the hexadecimal notation. More specifically, a code read from the code detector switches 25X is stored in the four bits, $b_0$ through $b_3$, for each article storage bin, and data indicating whether an article is stored in each article storage bin is stored in bit $b_5$. Bit $b_5$ indicates that there is an article in a bin when it is "1," and indicates that there is no article in a bin when it is "0." The bits $b_4$, $b_6$, $b_7$ are not used.

Operation of the control system constructed as above will be described below.

An article is supplied into an article storage bin through its front opening 4a (FIG. 2). When the article storage bins are positioned as shown in FIG. 1, for example, the operator depresses the loading switch LS once after the article has been loaded into the article storage bin 4-2 through its front opening 4a. The control unit 100 detects the depression of the loading switch LS to rotate the motor M in a direction to rotate the article storage bins 4 clockwise as shown in FIG. 1. The movement of the article storage bins 4 by one bin-to-bin interval is detected by the signal from the bin detector switch 25Z. The motor M is de-energized when the signal from the bin detector switch 25Z is subject to a positive-going transition from the OFF state to the ON state. Then, the operator loads an article into the next article storage bin 4-3.

After the articles have been successively loaded into the respective article storage bins, the operator depresses the set switch SS, and the control unit 100 detects the depression of the set switch SS to rotate the motor M in the direction to rotate the article storage bins 4 one revolution or at ten bin-to-bin intervals clockwise in FIG. 1. While the article storage bins 4 are being rotated one revolution, the control unit 100 counts an article storage bin each time a signal of positive-going transition is received from the bin detector switch 25Z.

At the same time, the control unit 100 successively reads signals (code) from the code detector switches 25X into the bits $b_0$ through $b_3$ of FIG. 16 and also reads signals from the article detector switch 38 into the bit $b_5$ into addresses successively from F009 toward F000. When the ten article storage bins are counted (i.e., they are circulated in one revolution), the control unit 100 de-energizes the motor M.

If after the article storage bins have been supplied with the respective articles, the bins are positioned as shown in FIG. 1, then the data items (article codes and the presence or absence of articles) for the respective article storage bins are as illustrated in FIG. 16. More specifically, the data items for the article storage bin 4-3 are stored in the address F009, the data items for the article storage bin 4-4 are stored in the address F008, the data items for the article storage bin 4-5 are stored in the address F007, the data items for the article storage bin 4-6 are stored in the address F006, the data items for the article storage bin 4-7 are stored in the address F005, the data items for the article storage bin 4-8 are stored in the address F004, the data items for the article storage bin 4-9 are stored in the address F003, the data items for the article storage bin 4-10 are stored in the address F002, the data items for the article storage bin 4-1 are stored in the address F001, and the data items for the article storage bin 4-2 are stored in the address F000. At this time, the data items for the article storage bin in the lowermost position (article discharge position) are stored in the address F000, and the positions of the respective article storage bins correspond to the memory addresses. Based on the stored data, the numbers of articles stored are counted for the respective article types (or codes), and stored in a remaining number memory 301 (FIG. 15) in the RAM 300. If the stored number or numbers are zero, then the sold-out indicator lamp or lamps ($LS_1$ through $LS_3$) are energized, and if not zero, they are de-energized. Where the articles are supplied to all of the article storage bins as shown in FIG. 16, the data items in the remaining number memory 301 are "4", "3", and "3" corresponding to the article type codes "0001", "0010", and "0011", respectively. The sold-out indicator lamps $SL_1$ through $SL_4$ are all deenergized. Thus, the sold-out condition is indicated when the data in the remaining number memory 301 is zero, and the sold-out condition is not indicated when the data in the remaining number memory 301 is nonzero.

Operation of the control system for vending an article will be described. When the customer inserts a coil N or coins, a coin signal is issued from a coin sorter device (not shown) to enable the control unit 100 to compute the amount of money inserted and store the same at a prescribed address in the RAM 300. Then, the control unit 100 compares the inserted amount of money with the prices of the article types (codes), and determines whether articles can be vended taking into account whether there is change to return and whether there are articles left (from the data in the remaining number memory 301). The control unit 100 energizes the sale-permit indicator lamp or lamps $VL_1$ through $VL_3$ for the articles that can be vended. When the customer depresses one of the selector switches $P_1$ through $P_3$ to select a desired article, the control unit 100 controls the vending machine to discharge the selected article if the selected article is salable.

Figure 18:
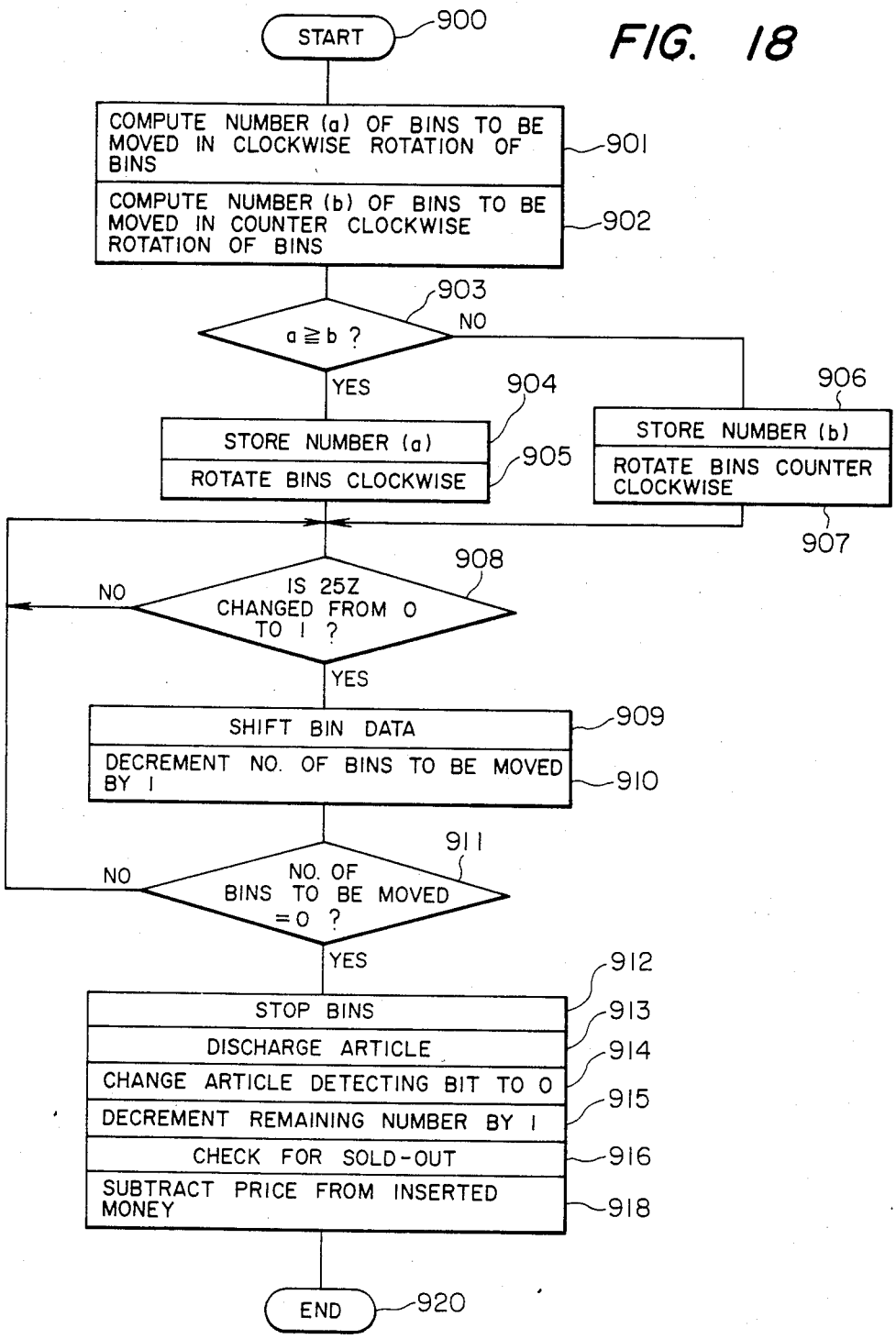
FIG. 18 is a flowchart of an operation program for the control system illustrated in FIG. 15.

FIG. 18 shows successive steps starting with 900 and ending with 920 for a vending cycle of operation of the vending machine. In step 901, the minimum number a of article storage bins to be moved when they are rotated clockwise in FIG. 1 for discharging the desired article is computed and stored at a prescribed address in the RAM 300. The number a of article storage bins to be moved can be computed from the address which stores the data items that first indicate that the article detecting bit $b_5$ is "1" (indicating the presence of an article) and the code in the bits $b_0$ through $b_3$ coincides with that of the selected article. The article detecting bit $b_5$ is scanned for "1" and the code is also scanned for coincidence with that of the selected article successively through the addresses in a decremental direction from F009, or can be determined by counting the frequency of such determination until the above first coincidence is achieved. Then, step 902 computes the minimum number b of article storage bins to be moved when they are rotated counterclockwise in FIG. 1 for discharging the desired article, and stores the computed number b at a prescribed address in the RAM 300.

The number b of article storage bins to be moved can be computed from the address which stores the data items that first indicate that the article detecting bit $b_5$ is "1" (indicating the presence of an article) and the code in the bits $b_0$ through $b_3$ coincides with that of the selected article while the article detecting bit $b_5$ is scanned for "1" and the code is also scanned for coincidence with that of the selected article successively through the addresses in an incremental direction from F001, or can be determined by counting the frequency of such determination until the above first coincidence is achieved. Then, step 903 compares the number a computed in step 901 and the number b computed in step 902. If $a \leqq b$, then the program goes to step 904, and if not $a \leqq b$, then the program goes to step 906. The step 904 stores the number a in a bin movement number memory 302 (FIG. 15) in the RAM 300. Then, step 905 rotates the motor M to turn the article storage bins 4 clockwise in FIG. 1, and the program proceeds to step 908. The step 906 stores the number b in the bin movement number memory 302. Then, step 907 reverses the motor M to turn the article storage bins 4 counterclockwise in FIG. 1, and the program proceeds to the step 908.

The step 908 ascertains whether the signal from the bin detector switch 25Z changes from "0" to "1" (detecting an article storage bin) or the bin detector switch 25Z changes from the OFF state to the ON state. If the signal of the bin detector switch 25Z changes from "0" to "1", then the program proceeds to step 909 in which the data items for the respective article storage bins are shifted one address in the direction of the arrows in FIG. 16 when the article storage bins 4 are rotated clockwise in step 905. More specifically, the data is shifted one address in an incremental direction such that the data in the address F000 is shifted to the address F001, the data in the address F001 is shifted to the address F002, and so on, and the data in the address F009 is shifted to the address F000.

When the article storage bins 4 are rotated counterclockwise in step 907, the data items for the respective article storage bins are shifted one address in the direction opposite to the direction of the arrows in FIG. 16. More specifically, the data is shifted one address in a decremental direction such that the data in the address F009 is shifted to the address F008, the data in the address F008 is shifted to the address F007, and so on, and the data in the address F000 is shifted to the address F009.

The program then goes to step 910 which decrements the data in the bin movement number memory 302 by 1. A step 911 then ascertains whether the data in the bin movement number memory 302 is zero or not. If not zero, the program returns to step 908, and if zero, the program goes to a step 912. Step 912 de-energizes the motor M to stop the rotation of the article storage bins 4, and then step 913 energizes the solenoid S to tilt the openable plate 8 to the dot-and-dash-line position of FIG. 2 to discharge the article from the article storage bin in the lowermost article discharge position into the article receiving container 7.

Step 914 changes the article detecting bit $b_5$ of the data (which is always stored in the address F000) on the bin from which the article has been discharged in the step 913, to "0" (indicating no article). Control then goes to step 915 which decrements by 1 the data of the remaining number memory 301 corresponding to the code of the article that has been discharged in step 913. Next, step 916 determines a sold-out condition based on whether the data in the remaining number memory 301 is zero or not, and energizes the sold-out indicator lamp or lamps $SL_1$ through $SL_3$ for the sold-out articles. In step 918, the price of the selected article is subtracted from the inserted amount of money to compute any difference, and the operation to discharge the selected article is finished in step 920. Thereafter, the computed difference is returned as change or is used for allowing the customer to select another article in the same manner as with conventional vending machines.

It is assumed that when data items are as shown in FIG. 16 with the article storage bins positioned as shown in FIG. 1, an article of the code "0011" is selected by depressing the selector switch $P_3$. As addresses F009 are successively scanned in a decremental direction, the article detecting bit $b_5$ first becomes "1" and the code (bits $b_0$ through $b_3$) first becomes "0011" in the address F004. Therefore, the number a of article storage bins computed in step 901 is 6. As addresses F001 are successively scanned in an incremental direction, the article detecting bit $b_5$ first becomes "1" and the code first becomes "0011" in the address F002. Therefore, the number b of article storage bins computed in step 902 is 2. Since $a>b$ in step 903, the program goes to step 906 to rotate the article storage bins counterclockwise.

In step 907, the number $b=2$ is stored in the bin movement number memory 302. When the article storage bins 4 are advanced counterclockwise in one bin-to-bin interval, that is, when the article storage bin 4-1 reaches the lowermost position in FIG. 1, step 908 detects the arrival of the article storage bin 4-1 at the lowermost position, and step 909 shifts the data items one address (one bin-to-bin interval) in the direction opposite to the direction of the arrows of FIG. 16.

As the article storage bins are advanced one more bin-to-bin interval in the counterclockwise direction, that is, as the article storage bin 4-10 reaches the lowermost position, the data items are similarly shifted one address in the direction opposite to the direction of the arrows of FIG. 16. When the article storage bins are thus moved two bin-to-bin intervals, the data in the bin movement number memory 302 is decremented twice or reduced to zero in step 910, and the motor M is de-energized in step 912. At this time, the data on the article storage bin 4-10 is stored in the address F000. In step 913, the solenoid S is energized to discharge the article from the article storage bin 4-10, and thereafter the article detecting bit $b_5$ in the address F000 is changed to "0". The data items for the respective article storage bins are now as shown in FIG. 17. In the step 915, the data stored in the remaining number memory 301 for the code "0011" is decremented by 1 and becomes "2."

Since the data items are shifted in step 909 in a direction depending on the direction of rotation of the article storage bins each time they are moved, the data items corresponding to the article storage bin located in the lowermost position is stored in the address F000 at all times, while the data items corresponding to the other article storage bins are stored in the addresses corresponding to the bin positions. Therefore, the addresses are indicative of the positions of the article storage bins.

Steps 901, 902 do not check the data in the address F000, i.e., if the selected article is stored or not. It is not necessary to check the data inasmuch as the article detecting bit $b_5$ in the address F000 is "1" (indicating the presence of an article) only when the articles are first vended after the articles have been supplied. If the above data check is effected, then there is an instance where an article can be discharged even without moving the article storage bins 4 only in the first vending cycle after the articles have been supplied.

Should a power failure occur, the article storage bins 4 may be circulated through one revolution to read and store the data items for the respective article storage bins as an initialization procedure after the power failure has been cleared. This is performed in the same manner as when the set switch SS is depressed. The RAM 300 may be backed up by a battery.

With the arrangement of the present invention, as described above, the control system includes discriminating means associated respectively with article storage bins for identifying the kinds of the articles stored in the article storage bins and whether there are articles actually stored in the article storage bins. A selected article is discharged on the basis of information from the discriminating means. Therefore, the articles of many different types can be vended through a single article conveyor mechanism. Vendable articles can easily be changed simply by replacing code plates indicating the article types in the discriminating means associated respectively with the article storage bins.

The selected article is discharged by computing the minimum numbers of article storage bins to be moved in the respective directions in which the article storage bins are movable and then moving the article storage bins in the direction of the smaller number of bins. As a consequence, the time required after the article has been selected until it is discharged is shortened.

The articles can be discharged in a first-in/first-out sequence by storing the order in which articles are supplied into article storage bins, so that the articles are of good quality when they are vended from the vending machine.

Although certain preferred embodiments have been shown and described, it should be understood that many changes and modifications may be made therein without departing from the scope of the appended claims.

The invention in its broader aspects is, therefore, not limited to the specific details, representative apparatus, and illustrative examples shown and described above. Thus, it is intended that all matter contained in the foregoing description or shown in the accompanying drawings shall be interpreted as illustrative and not in a limiting sense.

What is claimed is:

1. A control system for an article vending machine having a plurality of article storage bins mounted on a circulatory moving member for selective bidirectional rotation past an article discharge position and a device for making article selections, the control system comprising:

indicator means an each of the article storage bins for providing bin discription data indicating whether or not an article is present in the associated article storage bins and if so the type of article in the associated article storage bin and freshness data for the article;

sensing means for reading said bin description data and for generating corresponding bin reference data;

a memory for storing said bin reference data; and delivery control means, responsive to the selection of an article and in accordance with said stored bin reference data, for controlling the circulatory moving member to move through the minimum displacement to position a selected aricle storage bin to the article discharge position to inable the discharge of the selected article on a first in-first out basis if an article corresponding to the selected article is stored in one of the article storage bins.

2. A control system for an article vending machine having a plurality of article storage bins mounted on a circulatory moving member for selective bidirectional rotation past an article discharge position, the control system comprising;

discriminating means associated with each of the article storage bins for generating article storage data identifying the presence of an article in an associated bin and the type of the article if one is present in said associated bin; and article delivery control means for controlling the circulatory moving member to position a selected article storage bin to the article discharge position responsive to article selection data and said article storage data, said article delivery control means including means for sensing said article storage data and for producing bin reference data corresponding thereto and singly associated with each bin, said bin reference data including for each bin data indentifying the presence of an article in the bin, the type of article in the bin and the length of time that the article has been in the bin, said article delivery control means further including a memory for storing said bin reference data.

3. A control system according to claim 2, wherein said bin reference data includes bin position data identifying the position of the associated bin relative to the article discharge position.

4. A control system according to claim 3, wherein said delivery control means includes:

bin circulation control means coupled to said memory for determining from said bin reference data the direction of the minimum amount of displacement required of the circulatory moving member to position at the article discharge position a bin having an article therein corresponding to a selected article; and circulatory moving member actuator means for controlling the circulatory moving member to move in the direction and for the amount of displacement determined by said bin circulation control means to position at the article discharge position a bin containing a selected article.

5. A control system according to claim 4, wherein said bin circulation control means comprises a microprocessor.

6. A control system for an article vending machine having a plurality of article storage bins mounted on a circulatory moving member for selective bidirectional rotation past an article discharge position, the control system comprising:

a plurality of switch elements attached to each article storage bin and including switch elements selectively settable to indicate article storage data identifying the presence or absence of an article in a corresponding bin, the type of article in the bin, the date that an article was placed in the bin, and the cost of the article in the bin;

article delivery control means for controlling the circulatory moving member to position a selected article storage bin to the article discharged position responsive to article selection data and said article storage data, said article delivery control means including means for sensing said article storage data and for producing bin reference data corresponding thereto and singly associated with each bin, said bin reference data including for each bin data identifying the presence or absence of an article in the bin, the type of article in the bin, bin position data identifying the position of the associated bin relative to the article discharge position and the length of time that the article has been in the bin, said article delivery control means further including a memory for storing said bin reference data.

7. A control system according to claim 6, wherein said sensing means includes a switch readout including a plurality of switch contacts adapted to contact said switch elements of the article storage bins upon circulation of the article storage bins, said switch readout for generating said bin reference data in a manner permitting the association of said bin reference data and the corresponding article storage bin.

8. A control system according to claim 7, further including means for controlling said memory to store said bin reference data at selected addresses corresponding to the positional relationship between each of the article storage bins and the article discharge position.

9. A control system according to claim 6, wherein said delivery control means includes bin circulation control coupled to said memory for determining from said bin reference data the direction of the minimum amount of displacement required of the circulatory moving member to position at the article discharge position a bin having the least fresh article therein corresponding to a selected article; and circulatory moving member actuator means for controlling the circulatory moving member to move in the direction and for the amount of displacement determined by said bin circulation control means to position at the article discharge position the bin containing the least fresh article corresponding to a selected article.

* * * * *